US010215347B2

(12) United States Patent
Stauner et al.

(10) Patent No.: US 10,215,347 B2
(45) Date of Patent: Feb. 26, 2019

(54) LIGHTING ASSEMBLY WITH LIGHT FIXTURE MOUNTED IN ELECTRICAL BOX

(71) Applicant: ABL IP Holding LLC, Decatur, GA (US)

(72) Inventors: Joseph B. Stauner, Algonquin, IL (US); Kerry Scot Collins, Island Lake, IL (US)

(73) Assignee: ABL IP Holding LLC, Atlanta, GA (US)

( * ) Notice: Subject to any disclaimer, the term of this patent is extended or adjusted under 35 U.S.C. 154(b) by 4 days.

(21) Appl. No.: 15/373,748

(22) Filed: Dec. 9, 2016

(65) Prior Publication Data

US 2017/0167672 A1 Jun. 15, 2017

Related U.S. Application Data

(60) Provisional application No. 62/264,888, filed on Dec. 9, 2015.

(51) Int. Cl.

| | |
|---|---|
| ***F21S 8/02*** | (2006.01) |
| ***F21V 3/00*** | (2015.01) |
| ***F21V 21/04*** | (2006.01) |
| ***F21V 21/088*** | (2006.01) |
| ***F21V 23/00*** | (2015.01) |

(52) U.S. Cl.

CPC ..... *F21S 8/026* (2013.01); *F21V 3/00* (2013.01); *F21V 21/04* (2013.01); *F21V 21/088* (2013.01); *F21V 23/002* (2013.01)

(58) Field of Classification Search

CPC ... F21S 8/026; F21S 8/03; F21S 8/033; F21V 23/002; F21V 21/04; F21V 21/042; F21V 21/047; F21V 21/044; F21V 21/049; F21V 3/00; F21V 21/088

See application file for complete search history.

(56) References Cited

U.S. PATENT DOCUMENTS

| | | | | |
|---|---|---|---|---|
| 5,826,970 A * | 10/1998 | Keller | F21S 8/02 | 362/147 |
| 5,836,677 A * | 11/1998 | Connors | F21S 8/02 | 362/216 |
| 6,364,511 B1 | 4/2002 | Cohen | | |
| 8,097,806 B2 | 1/2012 | Lalancette et al. | | |
| 8,220,970 B1 * | 7/2012 | Khazi | F21V 29/004 | 362/373 |

(Continued)

FOREIGN PATENT DOCUMENTS

JP 2009004324 1/2009

OTHER PUBLICATIONS

Office Action for Canadian Application No. CA 2,951,300, dated Dec. 1, 2017, 5 pages.

CA 2,951,300, "Office Action," dated Oct. 3, 2018, 6 pages.

*Primary Examiner* — Y M. Lee

(74) *Attorney, Agent, or Firm* — Kilpatrick Townsend & Stockton LLP

(57) ABSTRACT

A light fixture includes a body with a first section at a first end and a second section at a second end and a light source disposed inside the body at the first end. In an installed configuration, the body is at least partially located inside an electrical box such that the first section and the first end are disposed inside the electrical box. The light source aims light from the first end toward the second end to illuminate an architectural space.

21 Claims, 4 Drawing Sheets

(56) References Cited

U.S. PATENT DOCUMENTS

| | | | | |
|---|---|---|---|---|
| 9,964,266 | B2 * | 5/2018 | Danesh | F21S 8/02 |
| 2014/0071679 | A1 * | 3/2014 | Booth | F21V 29/22 362/249.02 |
| 2015/0085500 | A1 * | 3/2015 | Cooper | F21V 21/044 362/365 |
| 2016/0312987 | A1 * | 10/2016 | Danesh | F21V 21/14 |

* cited by examiner

LIGHTING ASSEMBLY WITH LIGHT FIXTURE MOUNTED IN ELECTRICAL BOX

CROSS REFERENCE TO RELATED APPLICATION

This application is related to and claims priority benefit from U.S. Provisional Application No. 62/264,888 ("the '888 application"), filed on Dec. 9, 2015, entitled RECESSED LIGHTING FIXTURE MOUNTED IN A STANDARD ELECTRICAL BOX. The '888 application is hereby incorporated in its entirety by this reference.

FIELD OF THE INVENTION

The field of the invention relates to lighting assemblies having recessed lighting fixtures mounted directly in electrical boxes.

BACKGROUND

Electrical boxes for joining conductive wires and providing access thereto are generally mounted in panels (such as walls or ceilings) wherever mounted light fixtures exist. Accordingly, there are a large number of these electrical boxes installed in residential, commercial, and industrial settings. Such electrical boxes are often referred to as "junction boxes," which implies the box is relevant to multiple sets of conductors in two or more directions. As this may not necessarily be the case in all installations for the present invention, the broader term "electrical boxes" (which encompasses "junction boxes") is used herein.

Typical recessed down-lights (i.e., lights where the light source, usually incandescent, are recessed above the surface of a wall/ceiling) require mounting hardware, reflectors, frames, cans, and the like mounted above the ceiling plane. These recessed down-lights are typically large items (due to the bulbs and reflectors, among other components) and are connected to an electrical box separate from the light engine. Recessed lights thus often require significant skill, time, and planning to install. Furthermore, large amounts of materials are required to properly install such lights. It is also noted that fire ratings of the standard recessed fixtures are more complicated than a fire rating of a standard electrical box.

Some surface mounted down-lights are ceiling mounted with the light source entirely on the interior or "room" side of the ceiling panel (below the surface of the ceiling panel so as to be visible in a room) and can be easier to install but may lack aesthetic appeal of a recessed light due to glare and/or the presence various components (such as housing, reflector, etc.) below the surface of the ceiling when compared to recessed fixtures.

In certain situations, it may be desirable to design recessed lighting fixtures with reduced material and installation requirements that are aesthetically attractive.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a light fixture comprises: a body comprising a first portion at a first end and a second portion at a second end and a light source disposed inside the body at the first end, wherein: in an installed configuration, the body is at least partially located inside an electrical box such that the first portion and the first end are disposed inside the electrical box; and the light source aims light from the first end toward the second end to illuminate an architectural space.

According to certain embodiments of the present invention, a lighting assembly comprises: an electrical box; a light fixture that is at least partially disposed inside the electrical box; and an attachment unit for securing the light fixture inside the electrical box, wherein: the light fixture comprises a body comprising a first portion at a first end and a second portion at a second end and a light source disposed inside the body at the first end; the first portion and the first end are disposed inside the electrical box; and the light source aims light from the first end toward the second end to illuminate an architectural space.

According to certain embodiments of the present invention, a method of installing a light fixture comprises: inserting a light fixture into the opening of an electrical box, wherein: the light fixture comprises a body comprising a first portion at a first end and a second portion at a second end and a light source disposed inside the body at the first end; the first portion and the first end are disposed inside the electrical box; and the light source aims light from the first end toward the second end to illuminate an architectural space.

DETAILED DESCRIPTION

Figure 1:
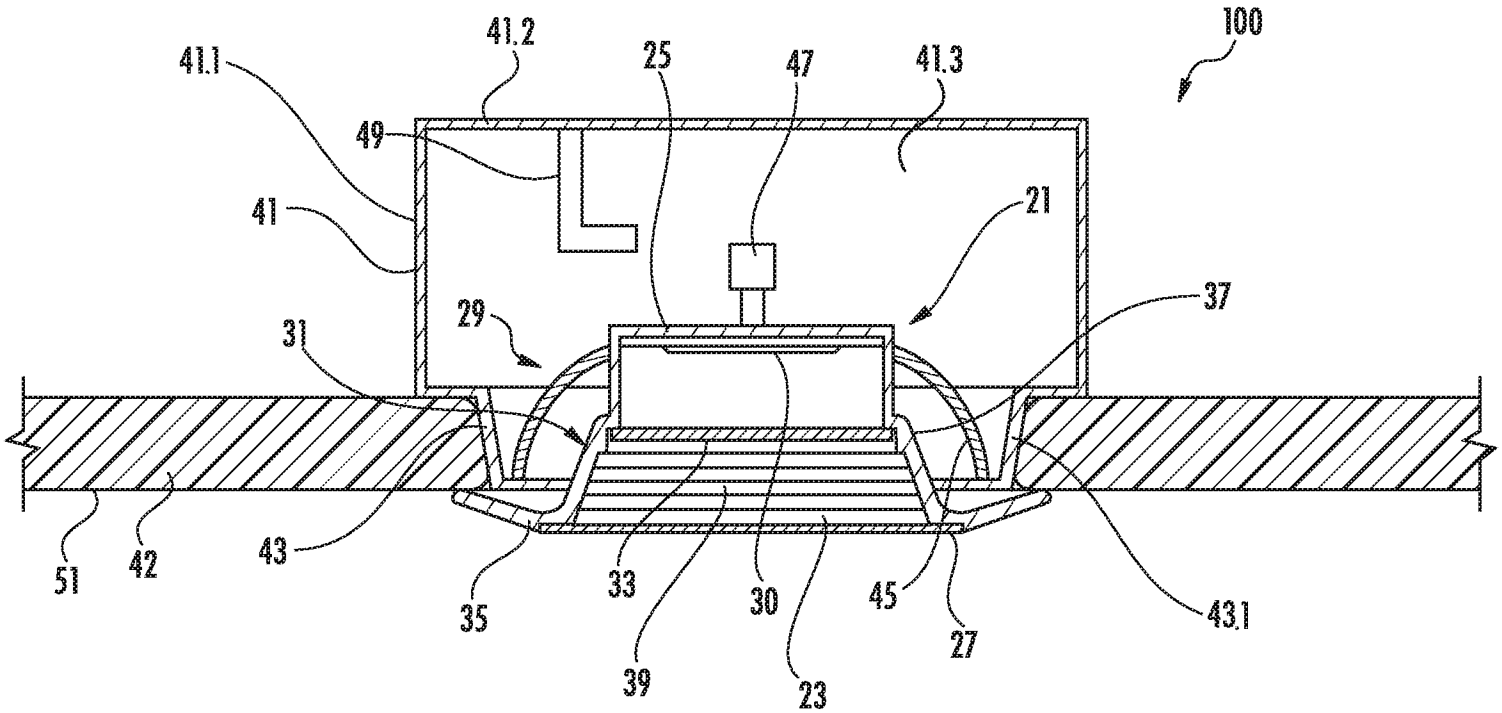
FIG. 1 is a cross-sectional view of an installed lighting assembly according to an embodiment of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1-4D illustrate embodiments of lighting assemblies 100 that include light fixtures 21 having an installed configuration such that the light fixture 21 is disposed at least partially inside an electrical box 41 and is oriented to illuminate an architectural space. The lighting assemblies 100 are shown installed and recessed at least partially within a panel 42, such as a ceiling, wall, or floor panel. Advances in technology related to the light sources allows for smaller fixtures that are capable of fitting partially or fully within an electrical box. In these embodiments, the light fixture 21 may include a one-piece body 23 with a first end 25 disposed at an upper end and a second end 27 disposed at a lower end. The body 23 may include (i) a first portion 29 with a light engine 30 near the first end 25 and (ii) a second portion 31 extending from the first portion 29 toward the second end 27. The first portion 29 and second portion 31 may be formed integrally or may be separate components that are attached together to form the body 23. A light engine 30 is arranged within the first portion 29 to emit light from the first end 25 toward the second end 27 such that light exits the second end 27 to illuminate the architectural space. The light engine 30 may include one or more light emitting diodes (LED) or any other light source such as fluorescent, incandescent, xenon, halogen, etc.

Figure 3:
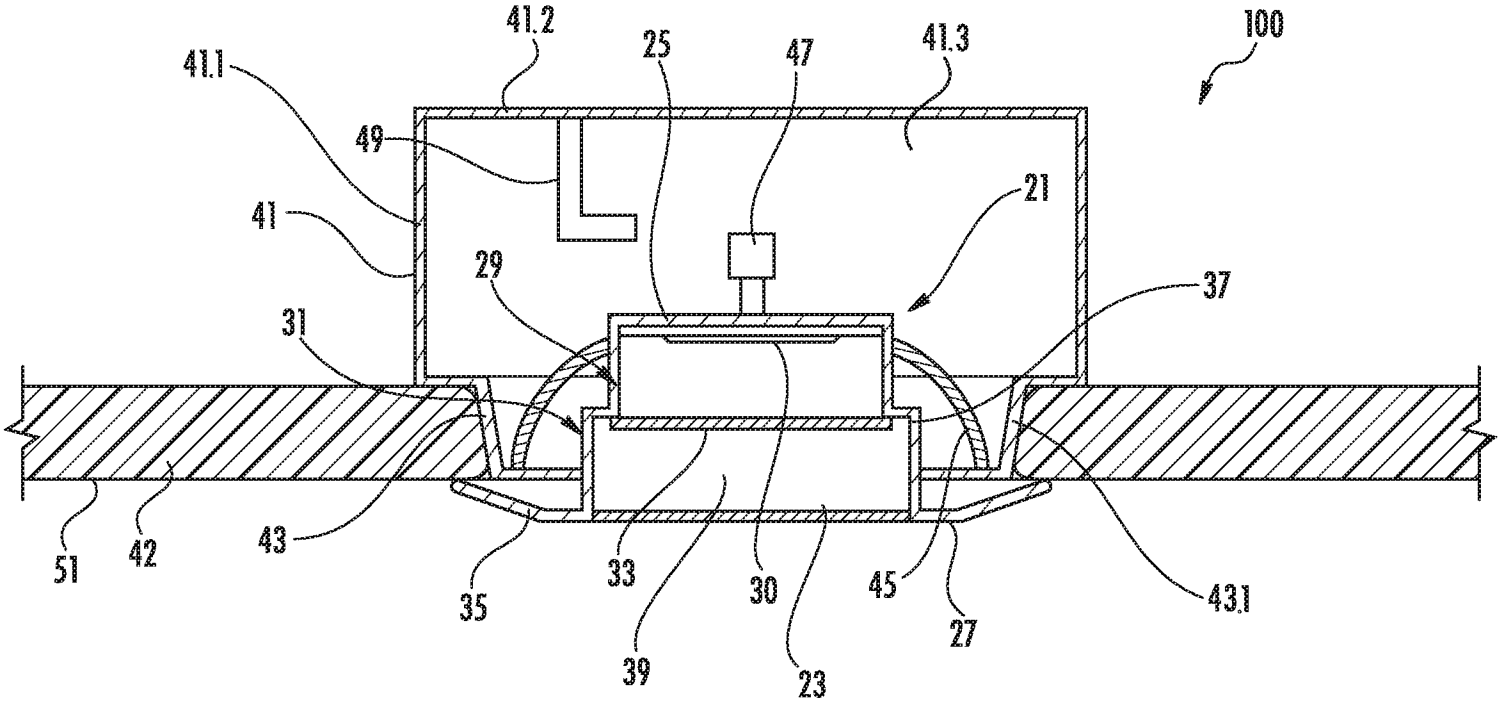
FIG. 3 is a cross-sectional view of an installed lighting assembly according to another embodiment of the present invention.
Figure 4A:
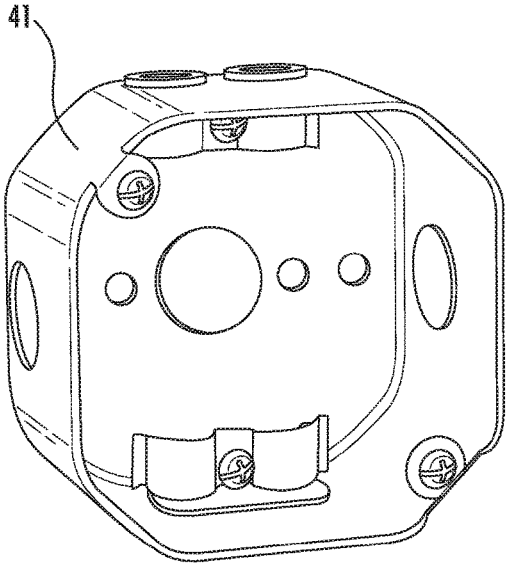
FIG. 4A is a perspective view of one embodiment of an electrical box for use in embodiments of the lighting assemblies disclosed herein.
Figure 4B:
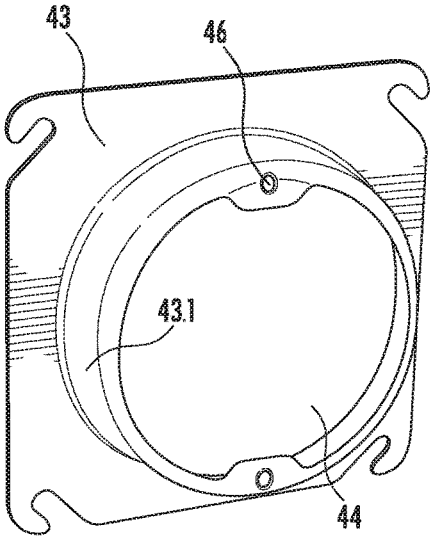
FIGS. 4B, 4C, and 4D are perspective views of embodiments of mud rings for use in embodiments of the lighting assemblies disclosed herein.
Figure 4C:
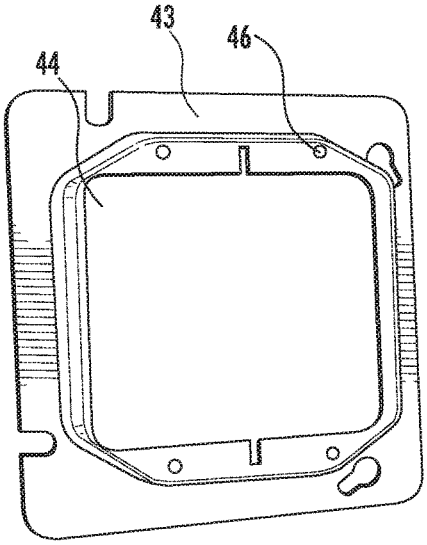
Figure 4D:
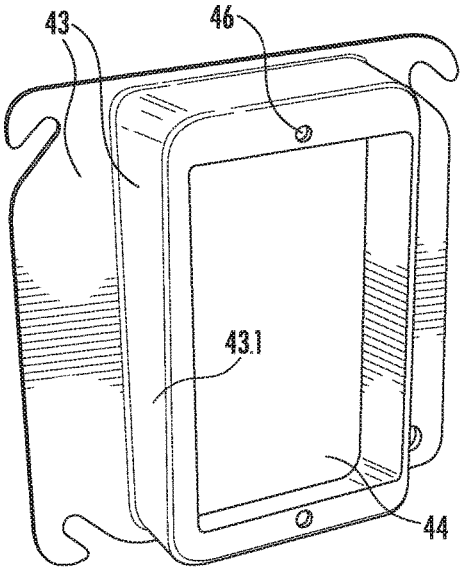

In some embodiments, the body 23 has an overall frustoconical shape although either or both of the portions 29 and 31 may be modified (e.g., more cylindrical than conical). The first portion 29 is cylindrical in some embodiments. In other embodiments, the first portion 29 comprises a box shape, a pyramid shape, a trapezoidal prism shape, or any other appropriate shape. The first portion 29 may have a constant cross-sectional shape (perpendicular to an axis extending between the first and second ends 25 and 27), as shown in FIGS. 1 and 3, or the cross-sectional shape may vary along the height and/or width of the first portion 29.

The second portion 31 may include a frustoconical shape (see FIG. 1), a box shape, a pyramid shape, a trapezoidal prism shape, a cylindrical shape, or any other appropriate shape. The second portion 31 may have a constant cross-sectional shape (perpendicular to an axis extending between the first and second ends 25 and 27), as shown in FIG. 3, or the cross-sectional shape may vary along the height and/or width of the second portion 31, as shown in FIG. 1. In some embodiments, as shown in FIG. 3, the second portion 31 extends in a direction that is approximately perpendicular to the interior surface 51 of the ceiling panel 42. In such embodiments, the interior wall(s) 39 of the second portion 31 may be a cylindrical surface or may be a series of planer surfaces where the second portion 31 is a box shape with a cross-sectional shape that is square, rectangular, octagonal, or any other appropriate shape.

A lens 33 may be disposed at an interface between the first and second portions 29 and 31. The interior wall 39 of the second portion 31 beneath the lens 33 may serve as a baffle section for controlling the directionality of light exiting the lens 33. In certain embodiments, the interior wall 39 may include a stepped surface (as shown in FIGS. 1 and 2). In some embodiments, the interior wall 39 may include a smooth or highly polished reflective surface (as shown in FIG. 3).

Figure 2:
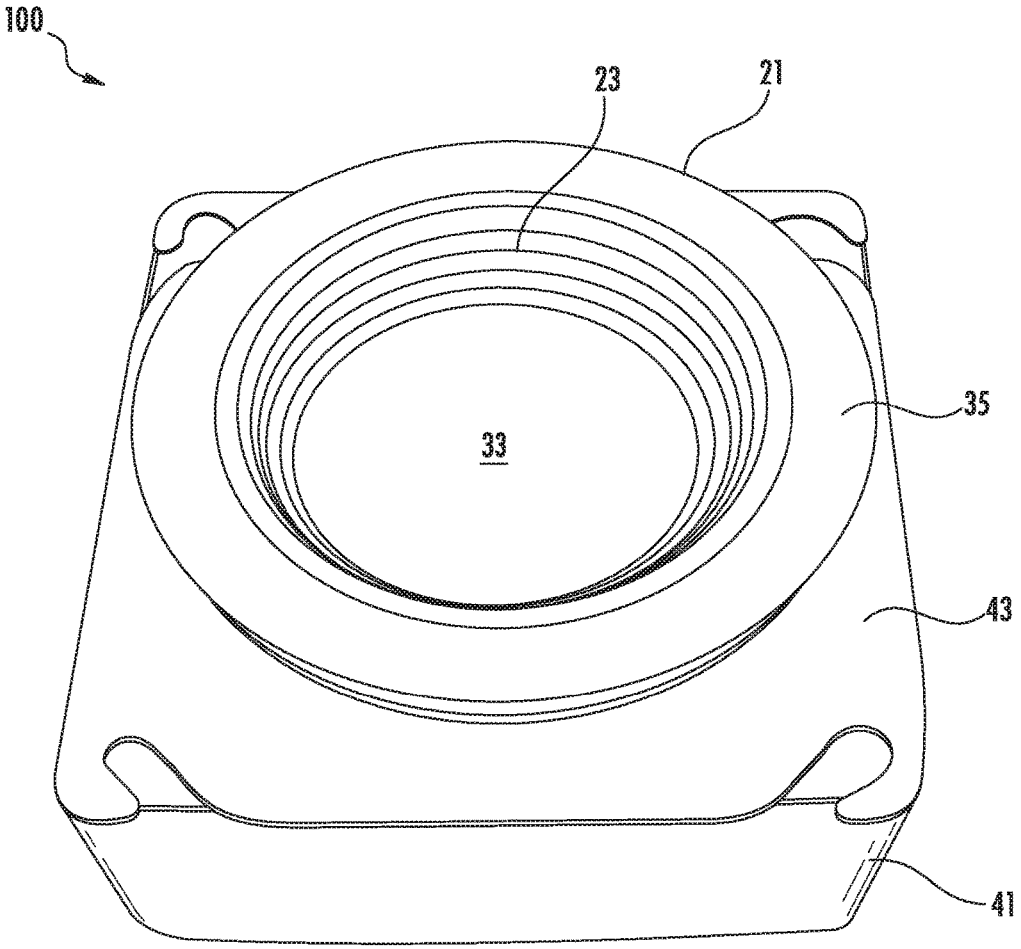
FIG. 2 is a perspective view of the bottom of the lighting assembly of FIG. 1 in isolation.

As shown in FIG. 1, in certain embodiments, the body 23 includes a trim ring 35 that may be formed as an integral part of the body 23 or as a separate component that is attached to the body 23. The trim ring 35 may extend outwardly from the exterior wall 37 of the body 23 at the second end 27. As shown in FIGS. 1 and 3, the trim ring 35 may extend from the second end 27 at an acute angle with respect to the interior surface 51 of the panel 42. The trim ring 35 may also extend in a direction that is approximately perpendicular to a direction extending between the first and second ends 25 and 27 (i.e., extend substantially parallel with the inner surface 51 of the panel 42). In some embodiments of a lighting assembly 100, when the light fixture 21 is in the installed configuration, the trim ring 35 is flush or substantially flush with the interior surface 51 of the panel 42 so as to surround the opening and impart a polished appearance to the installation.

The electrical box 41 includes at least one sidewall 41.1 and a top wall 41.2 that collectively define an interior space 41.3. The electrical box 41 may have a variety of different shapes, including, but not limited to, a square shape (see FIG. 2) or octagonal shape (see FIG. 4A). In some embodiments, the electrical box 41 includes a mud ring 43 intended to extend at least partially through the ceiling or wall thickness so as to define an opening in the ceiling or wall. The mud ring 43 has downwardly extending walls 43.1 that define a mud ring opening 44 to receive the light fixture 21. The walls 43.1 of the mud ring 43 may extend parallel to, or at an oblique angle relative to, the axis extending between the first and second ends 25 and 27. The mud ring opening 44 may be of a variety of different shapes, including, but not limited to, cylindrical (see FIG. 4B), square, octagonal (see FIG. 4C), rectangular (see FIG. 4D), or any other appropriate shape. The mud ring 43 may be an integral component of the electrical box 41 or may be a separate component (see FIGS. 4B-4D) that is attached to the electrical box 41. In some embodiments, a mud ring 43 is not provided on the electrical box 41. As shown in FIGS. 1 and 3, in certain embodiments, the lens 33 is located adjacent to the mud ring 43 (at approximately the same location along the axis extending between the first and second ends 25 and 27).

The light fixture 21 may be mounted to and at least partially located within the electrical box 41 above and adjacent the plane of the ceiling panel 42. The light fixture 21 is compatible with various electrical boxes, including boxes that have a mud ring 43 or boxes that do not include a mud ring. In some embodiments, each of the first and second portions 29, 31 are entirely disposed within the electrical box 41. As shown in FIGS. 1 and 3, in certain embodiments, the first portion 29 is entirely recessed inside the electrical box 41 and a portion of the second portion 31 is recessed inside the electrical box 41.

The light fixture 21 may be retained within the electrical box 41 by an attachment unit. In some embodiments, the attachment unit includes at least one retaining clip 45 provided on the exterior wall 37 of the first portion 29. By way only of example, the retaining clip 45 may be a spring steel member attached to the exterior wall 37. The retaining clip 45 is designed to pivot, bend, or otherwise move to a retracted configuration closer to the body 23 (not shown) so as to allow the first portion 29 to pass through the lower opening of the electrical box 41 (which may be defined by the mud ring 43). As shown in FIGS. 1 and 3, after the retaining clips 45 pass through the opening of the electrical box 41, the retaining clips 45 move to a deployed configuration and rest against an inner surface of the electrical box 41 (such as the mud ring 43). The attachment unit may include (either as a substitute for, or in addition to, the at least one retaining clip 45) one or more fasteners that engage holes 46 of the mud ring 43. In some embodiments, the fasteners extend through at least a portion of the trim ring 35 to the holes 46. The fasteners may be decorative and/or may be covered by a shroud, cover, cosmetic button, etc. The attachment unit may include one or more of the following: twist and lock mechanism; torsion springs; leaf springs (flipper springs); magnetic retention; friction springs; mouse trap springs; fasteners (rivets, screws, bolts, threaded rods, etc.); coil springs; or any appropriate attachment type.

Power connector wiring 47 from the light fixture 21 may extend into the interior of the electrical box 41 via a power connector wiring outlet (not shown) through the first portion 29. Branch circuit wiring 49 for the electrical box 41 may be connected to power the light engine 30. Any suitable connection apparatus between the branch wiring 49 and power connection wiring 47 may be utilized.

To install the light fixture 21 within the electrical box 41, the electrical connections between the electrical box and light fixture 21 are first made. Once the necessary electrical connections are completed (including power and/or dimming capabilities), the light fixture 21 may be pressed upwardly through the lower opening of the electrical box 41 (which may be defined by the mud ring 43) and into the electrical box 41 until the top side of the trim ring 35 contacts the interior surface 51 of the ceiling panel 42 (FIG. 1). The at least one retaining clip 45 deploys to support the light fixture 21 in a recessed position within the ceiling.

The components of the light fixture 21 may be formed of materials including, but not limited to, sheet metal, galvanized steel, aluminum, carbon composite, plastic, thermoplastic, stainless steel, other metallic materials, other composite materials, or other similar materials. Moreover, the components of the light fixture 21 may be attached to one another via suitable fasteners, which include, but are not limited to, screws, bolts, rivets or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A lighting assembly for recessed mounting on a panel, the lighting assembly comprising a light fixture comprising:

a) a light engine;

b) a fixture body housing the light engine and comprising a first end, a second end opposite the first end, an interior wall extending at least partially between the first end and the second end, and an exterior wall extending at least partially between the first end and the second end, wherein, in an installed configuration, the first end is disposed within a junction box with a power connection from the light engine extending beyond the fixture body for connection to wiring of the junction box, wherein at least a portion of the interior wall of the fixture body comprises a baffle section for controlling light output from the light fixture; and c) at least one retaining clip extending from the exterior wall of the fixture body for retaining the fixture body (i) within the junction box and (ii) against a surface of the panel, wherein:

the junction box is mounted such that at least a portion of the junction box is immediately adjacent to the panel;

the at least one retaining clip retains the fixture body within the junction box by engaging an internal surface of the junction box; and the internal surface is approximately parallel to the panel.

2. The lighting assembly of claim 1, wherein the light fixture further comprises a lens disposed in the light fixture below the light engine and between the first end and the second end.

3. The lighting assembly of claim 1, wherein:

the fixture body comprises a first portion proximate the first end and a second portion proximate the second end;

the first portion comprises a constant cross-section perpendicular to an axis extending between the first and second ends; and the second portion comprises a variable cross-section perpendicular to the axis.

4. The lighting assembly of claim 3, wherein the first portion has a substantially cylindrical shape and the second portion extends from the first portion and has a substantially frusto-concial shape.

5. The lighting assembly of claim 1, wherein the second end is disposed outside the junction box and the second end comprises a trim ring extending outwardly from the exterior wall such that the trim ring is configured to abut the surface of the panel when the light fixture is in the installed configuration.

6. The lighting assembly of claim 5, wherein the trim ring extends upwardly from the exterior wall of the fixture body at an acute angle to an axis extending between the first and second ends.

7. The lighting assembly of claim 1, wherein the junction box comprises a mud ring that extends at least partially through a thickness of the panel.

8. The lighting assembly of claim 1, wherein, in the installed configuration, a majority of the fixture body is located inside the junction box.

9. The lighting assembly of claim 3, wherein the first portion is disposed inside the junction box and the second portion is at least partially disposed inside the junction box.

10. The lighting assembly of claim 7, wherein the mud ring defines an opening of the junction box and the at least one retaining clip retains the fixture body within the junction box by engaging a surface of the mud ring that is approximately parallel to the panel.

11. A lighting assembly for mounting adjacent to a panel comprising:

a junction box;

a light fixture that is at least partially disposed inside the junction box; and an attachment unit for securing the light fixture inside the junction box, wherein:

the light fixture comprises a body comprising a first section at a first end and a second section at a second end; and a light source disposed inside the body at the first end;

the first section and the first end are disposed inside the junction box;

the light source aims light from the first end toward the second end and illuminates an architectural space;

the junction box comprises a mud ring that extends at least partially through a thickness of the panel; and the mud ring defines an opening of the junction box and the attachment unit retains the light fixture within the junction box by engaging a surface of the mud ring that is approximately parallel to the panel.

12. The lighting assembly of claim 11, wherein the attachment unit comprises at least one of a retaining clip and a fastener.

13. The lighting assembly of claim 11, wherein the attachment unit comprises at least one retaining clip that moves between (i) a deployed configuration where the at least one retaining clip presses against an inner surface of the junction box and (ii) a retracted configuration closer to the body.

14. The lighting assembly of claim 11, wherein the light fixture further comprises a lens disposed at an interface between the first section and the second section.

15. The lighting assembly of claim 11, wherein the first section comprises a cylindrical shape.

16. The lighting assembly of claim 11, wherein at least a portion of the second section is disposed inside the junction box.

17. The lighting assembly of claim 11, wherein the first section comprises a constant cross-section perpendicular to an axis extending between the first and second ends and the second section comprises a variable cross-section perpendicular to the axis.

18. A method of installing a recessed light fixture on or within a panel, the method comprising:

inserting the recessed light fixture into an opening of a junction box; and deploying at least one retaining clip to retain the recessed light fixture within the junction box by engaging an internal surface of the junction box, wherein:

the recessed light fixture comprises a body comprising a first section at a first end and a second section at a second end and a light source disposed inside the body at the first end;

the internal surface is approximately parallel to the panel;

the first section and the first end are disposed inside the junction box;

the light source aims light from the first end toward the second end and illuminates an architectural space; and the junction box is mounted immediately adjacent to the panel.

19. The method of claim 18, further comprising connecting wiring from the recessed light fixture to circuit wiring inside the junction box.

20. The method of claim 18, further comprising at least one of (i) moving the at least one retaining clip from a deployed configuration to a retracted configuration closer to the body to allow insertion of the recessed light fixture into the opening of the junction box and (ii) moving the at least one retaining clip from the retracted configuration to the deployed configuration to retain the recessed light fixture at least partially within the junction box.

21. The method of claim 18, further comprising arranging the junction box such that a mud ring of the junction box extends at least partially through a thickness of the panel.

* * * * *